United States Patent [19]

Hiersteiner

[11] Patent Number: 4,676,394

[45] Date of Patent: Jun. 30, 1987

[54] CARTON FOR RECEIVING AND SEALING AN INNER BAG

[76] Inventor: Walter Hiersteiner, 6142 Reinhardt Dr., Shawnee Mission, Kans. 66205

[21] Appl. No.: 796,597

[22] Filed: Nov. 8, 1985

[51] Int. Cl.[4] ..... B65D 5/54

[52] U.S. Cl. ..... 220/410; 206/621; 206/626; 229/17 R

[58] Field of Search ..... 220/410, 408; 229/17 R, 229/7 R; 206/621, 624, 626, 634

[56] References Cited

U.S. PATENT DOCUMENTS

| | | | |
|---|---|---|---|
| 2,321,655 | 6/1943 | Carr | 229/17 R |
| 2,337,730 | 12/1943 | Berch | 229/17 R |
| 2,339,156 | 1/1944 | Davis . | |
| 2,345,486 | 3/1944 | Leebov | 206/621 X |
| 2,593,778 | 4/1952 | McGinnis | 229/7 R X |
| 2,954,901 | 10/1960 | Winstead | 220/410 X |
| 3,128,934 | 4/1964 | Jacke . | |
| 3,168,233 | 2/1965 | Ignell | 206/626 X |
| 3,392,901 | 7/1968 | Krzyzanowski . | |
| 3,521,809 | 7/1970 | Zimmerman | 229/17 R |
| 4,141,449 | 2/1979 | Stone . | |
| 4,284,197 | 8/1981 | Meyers | 206/626 |
| 4,360,106 | 11/1982 | Irvine et al. | 206/621 |
| 4,484,683 | 11/1984 | Werner, Jr. . | |

*Primary Examiner*—Steven M. Pollard

*Attorney, Agent, or Firm*—Litman, Day & McMahon

[57] ABSTRACT

A carton for receiving and sealing an inner bag is provided. The carton, for example a cereal box, includes flexible tabs thereon oriented to engage a sealing fold selectively formed in a flexible bag received within the container. In the preferred embodiment, the flexible tab is formed by rupturing a portion in the sidewall of the container, along a tear-line provided therein. In an alternate embodiment, the flexible tab is formed from a modified flap mounted on an upper edge of the container. In still other alternate embodiments, containers with multiple flexible tabs for clamping an inner received bag shut, are presented. In all embodiments, the flexible tab or tabs provide clamping shut of the internally received bag by generally pinching a sealing fold, formed in the bag, between the tab(s) and an inner wall of the container.

11 Claims, 11 Drawing Figures

CARTON FOR RECEIVING AND SEALING AN INNER BAG

BACKGROUND OF THE INVENTION

The present invention relates to cartons, and in particular to cartons such as cereal boxes which retain an inner, flexible, bag.

Packaged food stuffs, such as breakfast cereals, are frequently sold in containers or boxes which include inner bags. The inner bags are generally formable or flexible, and are often made from materials such as foil, reinforced paper or the like. As the product is found on the store shelves, generally the foodstuffs are sealed within the inner bag which is itself enclosed within the carton. The inner bag is generally moisture resistant and helps maintain the foodstuffs therein in a fresh and uncontaminated state.

When a consumer first uses a product, the carton is opened, and the inner bag is unsealed. The consumer can then pour out a desired portion of the enclosed foodstuffs.

Generally, the package contains a greater quantity of foodstuffs than the consumer intends to eat at a given time. Thus, the package must be reclosed for storage. Generally, the inner bag, which has been opened along an upper seam, is closed by folding or rolling a portion of the paper or paper-like material, from which the bag is formed, over itself and pressing downwardly. Then, the outer carton, generally a cardboard box, is closed. Usually such cartons include flap portions with tabs and slots which can selectively engage one another to close the carton.

Although such an arrangement is very common, it is not fully satisfactory. First, the inner bag is often formed from a relatively, "stiff" material, such as reinforced paper. Such materials will generally resist the folding, and may slowly unfold or unroll, in time, to open the bag while inside the box. Further, if a consumer attempts to put a tight fold into the bag, in order to avoid this self-unfolding, the bag may tend to crease and form a tear. Should this occur, the contents of the bag may, again, be exposed to contamination and/or moisture.

In many instances, the inner bag is attached to an inside of the carton, as by an adhesive such as glue. This may help prevent the inner bag from being jostled within the container and possibly harming, as by crushing, the foodstuffs stored therein. In some instances, however, the adhesive or glue may deteriorate in time, allowing the bag to become detached from the inside of the carton. Further, in some instances, for economy or similar reasons, it may be desirable not to utilize an adhesive. Under either of these circumstances, the foodstuffs may become injured, with time, as the package is moved or shaken.

OBJECTS OF THE INVENTION

Therefore, the objects of the present invention are: to provide a carton suited for use in receiving and securing a bag therein; to provide such a carton especially suited for use as a container for a bag containing foodstuffs; to provide such a carton which includes a sealing mechanism to reseal a bag of foodstuffs stored within the container after the bag has been opened; to provide such a container having a flexible tab thereon oriented to engage a sealing fold in the flexible bag, as it is received within the container, and to pinch the sealing fold closed; to provide such a container with such a tab which is oriented to selectively, continuously, retain the bag sealing fold in a pinched and closed orientation; to provide such a container with a plurality of such tabs; to provide such a container in which a tab, utilized for maintaining an inner received bag in a sealed orientation, is simultaneously utilizable to help secure the received bag within the container; to provide such a container in which sealing tabs comprise a pair of flaps, on an upper edge of the container, which each include a bag engaging surface oriented such that folding of the flaps inwardly and downwardly within the container selectively engages a sealing fold on a received bag, and pinches the sealing fold against an inside wall of the container; to provide such a container which includes a single tab comprising a downwardly projecting tab portion of a sidewall of the container which can be selectively projected inwardly of the container to provide a clamp for pinching the bag sealing fold closed; to provide such a container with a single tab comprising an upwardly projecting tab portion of a sidewall which may be selectively projected inwardly of said container to form a clamp for pinching a sealing fold in the received bag against an inner sidewall of the container; to provide such a container in which a tab, for engaging a pinch fold on a received bag, is selectively formable along a tear-line in a sidewall of the container; to provide such a container which is relatively inexpensive to produce; to provide such a container which is easy to manufacture, relatively simple to use, and which is particularly well adapted for the proposed uses thereof; and to provide a method of securing closed a bag received within a carton.

Other objects and advantages of this invention will become apparent from the following description taken in connection with the accompanying drawings wherein are set forth, by way of illustration and example, certain embodiments of this invention.

SUMMARY OF THE INVENTION

A carton arrangement is provided for receiving a flexible bag of material therein. Generally, the carton or container, according to the present invention, is utilized in the food industry, for example, as a cereal box. Such cartons or boxes generally completely receive and retain a flexible bag of foodstuffs, such as cereal, therein. The flexible bag is generally sealed in the factory and is often made of material which is moisture resistant, in order to maintain the enclosed food materials in a relatively fresh and uncontaminated state. It will be understood that the invention may be utilized for cartons which store items other than foodstuffs, however it will be generally described in use to store consumables such as cereal.

Generally, when the package leaves the factory, the bag, enclosed within the carton, has a seal or seam along its upper edge. The consumer generally opens the top of the box and encounters this bag seam. The seam is then usually opened for access to the foodstuff contained within the bag. If less than the complete contents of the bag are used, a folding seal is generally formed in the top of the bag by pressing side portions of the bag against one another and folding or rolling them over once or twice, as is conventional for closure of a paper bag or similar item. The top of the carton is then closed, usually by means of flaps mounted thereon which engage one another.

As previously described, under such conditions the inner bag may not be adequately sealed. First, the sealing fold formed in the top of the bag may tend to unwind and open itself, in time. Also, consumers who try to very tightly wind the sealing fold, in attempts to ensure that it remains closed, may inadvertently injure the structural integrity of the bag, as by forming a rip therein, thus opening the bag and exposing the foodstuffs to the air, so that the food may become contaminated by moisture or foreign materials.

The carton or container according to the present invention includes means therein to engage the sealing fold in the bag and securely pinch it closed. Generally, this is accomplished by means of a tab or tabs attached to the carton which can selectively engage the sealing fold in the bag and pinch it in a clamping manner. This is presented in numerous embodiments, as described below.

In the preferred embodiment, the tab utilized to pinch the sealing fold of the bag is formed along a tear-line in a sidewall of the carton or container. As used herein, the term "tear-line" refers to a line in the sidewall of the carton which has been weakened, as by perforation or the like. Such tear-lines are commonly utilized, for other purposes, in cartons made from cardboard or the like. For the instant invention, the tear-line defines a flexible tab hingedly attached to the container sidewall. That is, once the tear-line has been broken, a tab, similar to a thumb of cardboard material, forms in the container sidewall. In the preferred embodiment, the tear-line defines a generally bowl- or crescent-shaped tab with its convex side or edge projecting primarily downwardly.

Preferably, the tear-line is oriented in the container sidewall such that the tab is formed substantially near an upper end of the container sidewall, and is oriented relatively near, but lower than, the end of the bag which is to be opened. Then, after the bag has been opened, and resealed by the folding seal, the bag folding seal can be selectively pressed between the flexible tab and an inner sidewall portion of the box, in a pinching or clamping arrangement. It will be readily understood from the detailed description and the drawings, that engagement between the bag and the tab is facilitated by pressing the tab to project inwardly of the box and orientating the sealing fold between the tab and an inside wall of the container. Since the box will generally be formed from a relatively rigid material, such as cardboard, the tab, while hingedly attached to the box, includes a hinged portion which is relatively resistant to the inward deformation. As a result, the tab will have a tendency to bias toward its non-deformed position, aiding in clamping of the bag.

In an alternate form of the invention, the tab is bowl- or crescent-shaped with its convex side or edge projecting generally upwardly. As is seen from the drawings, utilization of such an arrangement is generally analogous to that described above.

In a second alternate embodiment, the container includes a plurality of retaining tabs oriented along a generally horizontal line so a bag sealing fold may be engaged and pinched at more than one location, for a more secure arrangement. Further, when a plurality of tabs are utilized, it is possible that each may be made somewhat smaller than is a tab, in a sidewall, when only one tab is used. This may aid in maintaining the structural integrity of the container sidewall. Such an arrangement may also be useful for a container which includes more than one bag, positioned side-by-side.

In a third alternate embodiment of the present invention, a plurality of tabs are positioned in the container sidewall, generally oriented vertically with respect to one another. Such an arrangement may be preferred in a tall package for an inner bag which, with continuous use, includes less and less food material and therefore may be folded with the sealing fold located in successively lower and lower vertical orientations. Thus, initially, the upper-most tab might by utilized, with the lower tab being later used as a container becomes less full. Such an arrangement may also be useful for a container which includes more than one bag, one on top of the other.

Conventional containers, such as cereal boxes, generally include a plurality of foldable flaps along an upper edge, which are folded toward one another, and engage one another, to close a top of the container or box. For a box such as a cereal box, which is generally rectangular in cross section, there are usually four such flaps comprising two pairs of oppositely oriented flaps. The first pair comprises a generally elongate set of flaps which extend along relatively wide front and rear portions of the box; and the second pair comprises relatively short tabs or flaps, one mounted on an upper end of each endwall of the container. In a fourth alternate embodiment of the present invention, the flaps associated with the endwalls are modified for utilization as tabs to pinch or clamp the inner bag sealing fold against an inner sidewall of the carton.

In the fourth embodiment, the tabs, which in conventional boxes are generally rectangular, are modified by including a pinch fold engaging surface thereon, preferably by truncating a corner of the flap. As will be understood by the detailed description and the drawings, when such tabs are folded to project inwardly of said box, and generally downwardly, they may be positioned to engage the sealing fold of the bag, trapping it between the tabs and a near sidewall of the box, to clamp the bag shut. Such an arrangement would be preferred in some instances, since it leads to a sealing of the received bag, while retaining the structural integrity of sidewall surfaces of the container.

It will be understood that while the tear-lines above described are generally termed as "crescent-shaped", tabs of numerous shapes may be utilized according to the present invention.

The drawings constitute a part of this specification and include exemplary embodiments of the present invention and illustrate various objects and features thereof. In some instances the relative thickness of the materials may be shown exaggerated for clarity.

DETAILED DESCRIPTION OF THE PREFERRED EMBODIMENT

Figure 1:
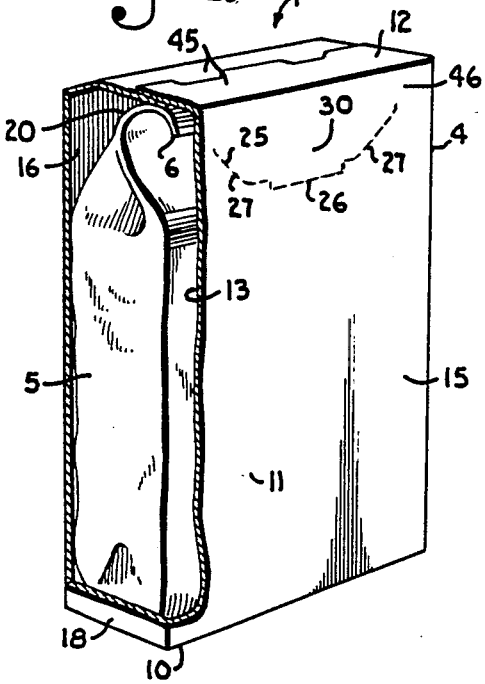
FIG. 1 is a perspective view of a container according to the present invention, with portions broken away to show a bag of material received within the container.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

Referring to the drawings in more detail:

The reference numeral 1, FIG. 1, generally designates a container or a box according to the present invention. In FIG. 1, the box depicted is a modified cereal carton or box 4, which has, contained therein, a flexible bag 5. The container 1 of FIG. 1, is generally depicted as it would appear on a store shelf, with the bag 5 filled with cereal and sealed along its upper edge 6. A variety of seals may be used, including an adhesive or the like.

Figure 5:
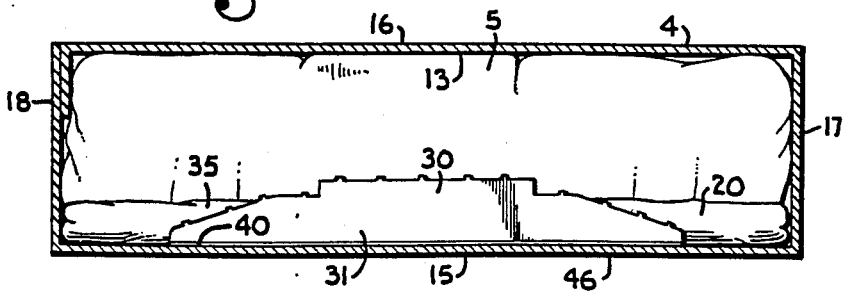
FIG. 5 comprises an enlarged, top cross-sectional view taken generally along line 5—5 of FIG. 3.

Except as described below, the cereal box 4 may be of conventional construction and includes a base 10, a sidewall portion 11, and a top 12 which define an internal bag-receiving chamber 13. Referring to FIG. 5, in the preferred embodiment the box 4 is rectangular, and the sidewall portion 11 generally includes a front face 15, a rear face 16 and first and second end faces 17 and 18. As used herein, the term "front face" is utilized to designate the sidewall 18, FIG. 1, which has been modified according to the present invention, or against which the inner bag 5 is pressed during sealing as described below. The terms "front face" and "rear face" are not intended to have any further meaning and specifically are not intended to relate to any pictures or advertising indicia which may be printed on the box.

As indicated above, FIG. 1 generally depicts a cereal box 4, according to the present invention, as it would appear on a store shelf. When a consumer desires access to the cereal, generally the top 12 is opened in a conventional manner, analogous to that shown in FIG. 2, exposing the inner bag 5 and its upper seal 6. The bag 5 may then be opened along its upper seal 6 so that cereal may be poured therefrom. Often the flexible bag 5 is attached to the box 4 by means of an adhesive or the like, in part so that the bag 5 does not move independently of the box 4, possibly crushing the food contents.

Generally, the bag 5 is formed from a moisture-resistant or somewhat moisture-proof material such as a treated paper of foil, so that the food contents may be stored in a relatively moisture-free and contaminant-free environment. If, following opening of the seal 6, the consumer utilizes less than the complete contents of the bag 5, prior to storage of the box 4 it will be desired to reseal the bag 5. This latter, would, of course, be to avoid excessive moisture contacting the stored foodstuffs, and to otherwise generally avoid contamination. However, generally the seal 6 cannot be readily reintroduced into the bag 5, once it has been broken or opened. This generally necessitates an alternate method of resealing the bag 5.

Prior to the present invention, generally the bag 5, FIG. 1, would be resealed by folding or rolling its upper portion 20 over itself several times, and then simply reclosing the top 12 of the box 4. A problem with this approach is that if relatively stiff material, such as a treated paper, is utilized for the bag 5, the fold in the upper portion 20 may tend to open itself during storage, exposing the contents of the bag 5. Further, should the consumer tightly wind the upper portion 20 in an attempt to form a tight seal or fold, then the bag may be weakened or torn, again exposing the internal materials.

Generally, the solution to these problems would be to provide a clamp by which a sealing fold in an upper portion 20 of the bag 5 can be pinched closed. The present invention relates to means by which such a clamp may be provided by structural members in the box 4. This is illustrated in numerous embodiments described below.

The preferred embodiment is illustrated in FIGS. 1 through 5, inclusive. Referring to FIG. 1, a tear-line 25 is provided in one of the sidewalls 11, in this instance the front face 15 of the container or box 4. The tear-line 25 generally comprises a weakened portion or line along which the side 15 may be easily ruptured. In the preferred embodiment, FIGS. 1 through 5, the tear-line 25 is a perforated portion of the box 4 which may be readily torn. In the embodiment of FIG. 1, the tear-line 25 is generally crescent- or bowl-shaped, with a convex portion projecting downwardly. As will be readily understood from the description and the drawings, by "crescent-shaped" it is not meant that the tear-line 25 defines or needs to define a smooth curve. For example, in the preferred embodiment depicted, the tear-line 25 includes a flat portion 26 and generally symmetrical sides 27. However, it will be readily understood that a variety of shapes of tear-lines 25 may be utilized according to the present invention.

Figure 2:
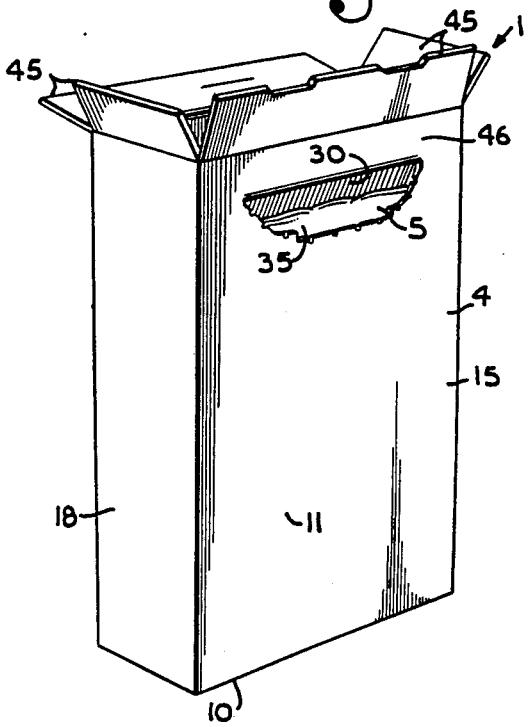
FIG. 2 is a perspective view of a container according to the present invention, depicted with a top portion opened and with an internally received bag sealed and retained according to the present invention.
Figure 4:
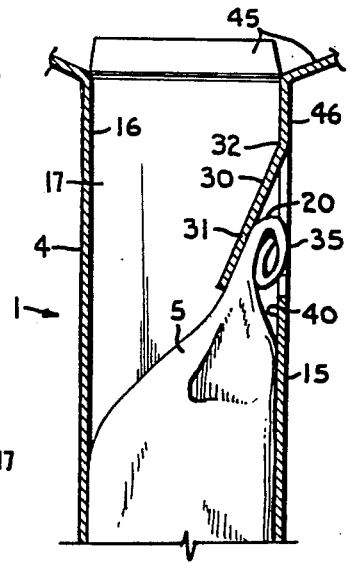
FIG. 4 comprises an enlarged, fragmentary, side cross-sectional view taken generally along line 4—4 of FIG. 3.

The tear-line 25 defines a tab 30 in the box face 15 which may be pressed inwardly, FIG. 2, during or following rupturing of the tear-line 25, to deform or project inwardly of the box 4, FIG. 4. The tab 30 then forms a flap 31, FIG. 4, integrally attached to the sidewall 15 at a hinged portion 32. Since the box sidewall 15 is generally formed from cardboard or the like, the hinged portion 32, unless fairly deeply creased, will generally tend to bias the flap 31 toward alignment with the remainder of the sidewall 15.

In FIGS. 2 through 5, inclusive, it is illustrated how the flap 31 may be utilized to maintain a previously opened bag 5 in a closed or sealed orientation. Referring to FIG. 4, the bag 5, once opened and partially emptied, is shown with its upper portion 20 rolled or folded into a sealing fold 35. As described above, in the absence of a clamp, the sealing fold 35 would possibly tend to unwind or open itself in time. However, in FIG. 4, the sealing fold 35 is shown oriented between the flap 31 and an inner surface 40 of the sidewall 15. The fold 35, once trapped between the flap 31 and the sidewall 15 is generally prevented from opening, and will tend to remain pinched or clamped shut during storage. It is noted that, in FIG. 4, the fold 35 is shown "rolled" toward the wall 40, however an opposite direction of rolling will work.

Figure 3:
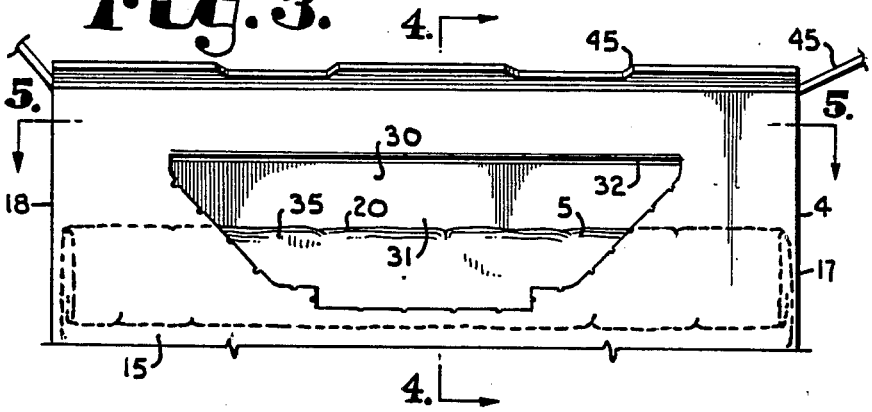
FIG. 3 comprises an enlarged, fragmentary, front elevational view of a portion of the container shown in FIG. 2.

In FIG. 2, the box 4 is shown with the bag sealing fold 35 clamped shut by the tab 30. FIG. 3 depicts this in an enlarged view, with a portion of the sealing fold 35 shown in phantom lines. FIG. 5 depicts a top view showing the tab 30, after rupturing, retaining the sealing fold 35 against the inner wall surface 40.

It will be readily understood that clamping-type action of the tab 30 not only will aid in maintaining the sealing fold 35, but it will also assist in preventing independent movement of the bag 5 in the box 4, thus aiding in protecting the contained foodstuffs from damage during any shaking of the box 4.

Referring again to FIGS. 1, 2 and 4, once the bag 5 has been oriented relative to the flap 31, for retaining of the sealing fold 35, top flaps 45 of the box may be closed, as in FIG. 1, retaining the bag 5 completely within the container 1.

Referring to FIGS. 1 and 4, preferably the tear-line 25 is oriented near an upper portion 46 of the sidewall 15. In this manner, the tab 30, FIG. 2, will be formed near the top of the box 4, so that an inner bag 5 may be engaged even when it is nearly full. Referring to FIG. 4, preferably the inner bag 5 will be formed from a relatively stiff material, such as a treated paper material or foil, and will be sufficiently rigid to maintain the upper sealing fold 35 near the flap 31, even when the bag is considerably empty.

Figure 6:
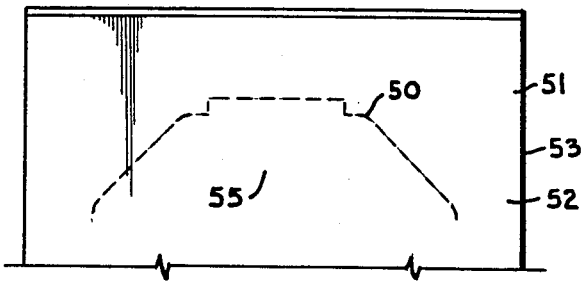
FIG. 6 comprises an enlarged, fragmentary, front elevational view of a portion of a container according to a first alternate embodiment of the present invention.
Figure 7:
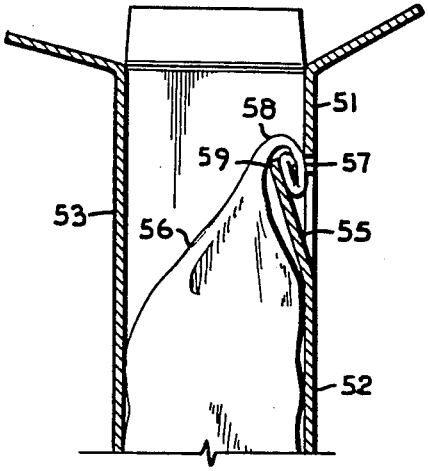
FIG. 7 comprises an enlarged, fragmentary, side cross-sectional view of the embodiment depicted in FIG. 6, taken generally from a perspective analogous to that of line 4—4 in FIG. 3.

A first alternate embodiment of the present invention is depicted in FIGS. 6 and 7. In FIG. 6, a tear-line 50 is shown in an upper portion 51 of a sidewall 52 of a box 53. As in FIG. 1, the tear-line 50 generally outlines a bowl- or crescent-shaped tab 55. The tab 55 of the embodiment of FIGS. 6 and 7, is oriented to project its convex edge generally upwardly. Engagement of a bag 56 with such a tab 55 will be readily understood by reference to FIG. 7. Here a sealing fold 57 in an upper end 58 of the bag 56 is engaged by first folding over a tip 59 of the tab 55. The embodiment of FIGS. 6 and 7 is generally otherwise analogous to that of FIGS. 1 through 5.

Figure 8:
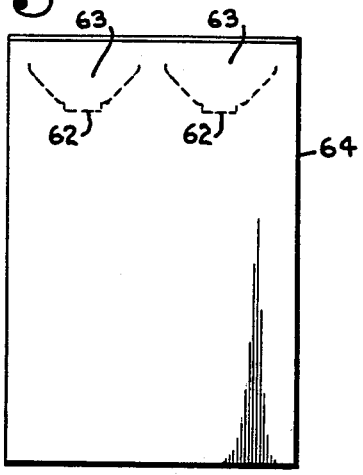
FIG. 8 comprises a front elevational view of a container according to a second alternate embodiment of the present invention.

A second alternate embodiment of the invention is illustrated in FIG. 8. Here a plurality of tear-lines 62 is shown defining a pair of tabs 63. In this manner, an upper sealing fold of a bag, not shown, retained within the box 64 may be pinched or clamped in two separate positions along a horizontal extension thereof. In FIG. 8, the tear-lines 62 form two tabs 63, however it will be readily understood that a different number of tear-lines may be utilized with analogous results. It will also be understood that the embodiment of FIG. 8 may be utilized when the box includes more than one bag in a side-by-side orientation.

Figure 9:
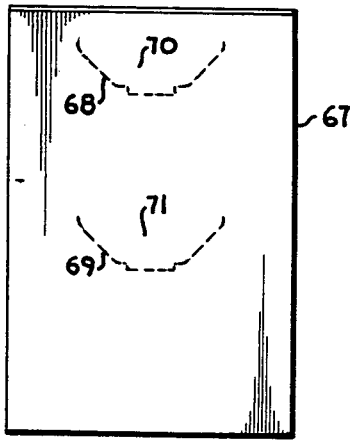
FIG. 9 comprises a front elevational view of a container according to a third alternate embodiment of the present invention.

A third alternate embodiment of the present invention is illustrated in FIG. 9. Here, a box 67 is shown with two vertically disposed tear-lines 68 and 69 therein. Such an arrangement may be desirable for a particularly tall box, where considerable folding of an internally received bag, not shown, may be desired as the bag empties of its contents. It may also be used for a box which includes two bags therein, one on top of the other. Thus, while the bag is substantially filled, or an upper bag is used, tab 70 defined by tear-line 68 might be utilized; and as the bag empties, or a lower bag is used, tab 71, defined by tear-line 69 may be engaged. It will be readily understood by examination of FIG. 9, that although two tear-lines 68 and 69 are shown, varying numbers of tear-lines might be utilizable.

It will also be readily understood, by comparison of FIGS. 8 and 9, that, if desired, for the embodiment of FIG. 8 a second pair of horizontally disposed tear-lines could be provided on a lower portion of the box 64.

Figure 10:
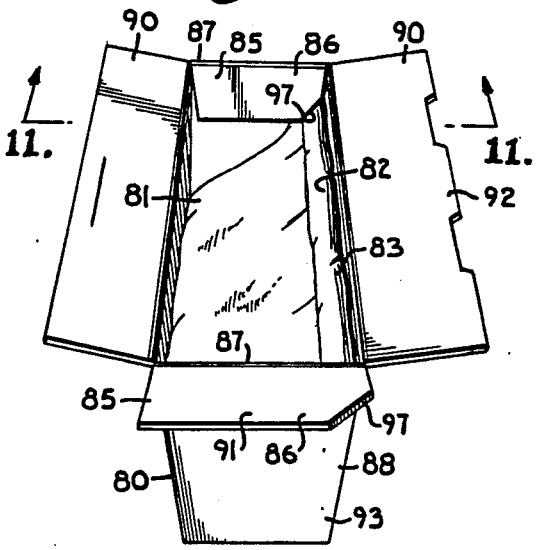
FIG. 10 comprises a top perspective view of an open container according to a fourth alternate embodiment of the present invention, shown in partial sealing engagement with an internally received bag.
Figure 11:
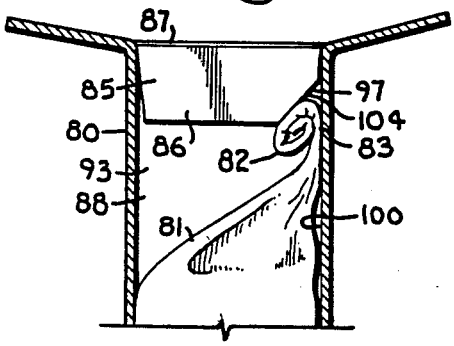
FIG. 11 comprises a fragmentary, side cross-sectional view taken generally along line 11—11 of FIG. 10.

A fourth alternate embodiment of the present invention is illustrated in FIGS. 10 and 11. The embodiment of FIGS. 10 and 11 may be desired when it preferred that structural integrity of the container or box sidewalls be generally maintained, even when the bag is pinched shut. Referring to FIG. 10, a carton or box 80 is shown with a bag 81, containing foodstuffs, received therein. The bag 81 includes a sealing fold 82, generally analogous to sealing fold 35 in FIG. 4, in an upper portion 83. For the embodiment of FIGS. 10 and 11, however, tabs 85, which pinch or clamp the sealing fold 82, are not formed from a tear-line in the carton 80. Rather, the tabs 85 are flaps 86 hingedly mounted on an upper edge 87 of the sidewalls 88 of the box 80.

Referring again to FIG. 10, the box 80 includes two pairs of flaps 90 and 91, generally in an conventional manner except as described below. Elongate side flaps 90 are hingedly mounted along the longer edges of the top of the box and when folded over engage one another by means of extension 92, in a conventional manner.

Endwalls 93 of the box 80 have the generally rectangular flaps 91 mounted thereon, along an upper edge. In conventional box tops, such flaps are usually folded immediately underneath the elongate side flaps 90. For the preferred embodiment, the flaps 91 comprise the tabs 85 and are generally rectangular in configuration, but for a truncated corner 97 on each which is oriented toward an inner face of sidewall 100 against which the sealing fold 82 is to be pinched. It will be readily understood by reference to FIG. 11, that when a tab 85 is folded inwardly and downwardly, the truncated corner 97 becomes a bag sealing fold engaging portion 104. In FIG. 11 the bag sealing fold 82 is shown clamped between a sidewall 100 and truncated corner 97. It is noted that in FIG. 11 the bag fold 82 is shown "rolled" away from the wall 100, however an opposite direction should be possible.

Referring again to FIG. 10, it will be understood that both flaps 85 can be utilized to clamp the sealing fold 82. Following this, it will be understood that the elongate flaps 90 can be closed in a conventional manner to completely and securely enclose the bag 81 within the carton 80.

It is noted that while the present invention is generally described for use with a cereal box, it may be utilized for numerous containers having bag receiving chambers therein, in which a previously opened bag is to be stored and sealed.

It will also be understood from the detailed description, and the drawings, that the instant invention includes a method by which a previously opened bag can be stored, sealed, within a container. The method will generally comprise the steps of providing an appropriate container, providing a tear-line in an appropriate location in the container, and utilizing rupturing of the tear-line to form a tab to appropriately engage a sealing fold of a received bag.

It is to be understood that while certain forms of the present invention have been illustrated and described herein, it is not to be limited to the specific forms or arrangement of parts described and shown.

What is claimed and desired to be secured by Letters Patent is as follows:

1. A carton for receiving and retaining an inner, flexible, bag in a sealed orientation; said carton comprising:
(a) a container having a sidewall portion with an interior wall surface and an interior, bag-receiving, chamber;
(b) a flexible tab mounted on said container;
(i) said flexible tab being oriented to selectively engage an upper sealing fold in a flexible bag received within said container chamber and to press the sealing fold against the interior wall surface, to selectively maintain the sealing fold in a folded and sealed orientation;
(c) whereby, following opening of the flexible bag, the carton may be used to reseal and contain the flexible bag, by means of said tab securing and maintaining the sealing fold in the bag.

2. A carton according to claim 1 wherein:
(a) said sidewall portion includes a generally planar sidewall face; and
(b) said flexible tab comprises a flap formed in said sidewall face and hingedly attached thereto;
(i) said flap being selectively deformable to project generally inwardly of said container, from said sidewall;
(ii) said flap including a hinged portion generally tending to resist deformation of said flap to project inwardly from said sidewall;
(c) whereby a tendency of said flap hinged portion to resist projection of said flap inwardly of said sidewall face facilitates the sealing of the bag by enabling the sealing fold in the bag to become pinched between the flap and the wall inner surface.

3. A carton according to claim 2 wherein:
(a) said container includes a container base; and
(b) said flap comprises a generally crescent shaped extension, in said sidewall face, having a generally convex edge;
(i) said convex edge projecting upwardly as said container stands on said container base;
(c) whereby said bag sealing fold is engaged by passing said sealing fold over said convex edge and pressing said sealing fold against said wall inner surface.

4. A carton according to claim 2 wherein:
(a) said container includes a container base; and
(b) said flap comprises a generally crescent shaped extension, in said sidewall face, having a generally convex edge;
(i) said convex edge projecting downwardly as said container stands on said container base;
(c) whereby said bag sealing fold is engaged by pressing said fold upwardly to a position between said flap and said wall inner surface.

5. A carton for receiving and retaining an inner, flexible, bag in a sealed orientation; said carton comprising:
(a) a container having a base, a sidewall portion with an upper edge and an interior wall, and an interior, bag-receiving chamber; and
(b) a foldable flap hingedly mounted on said sidewall portion upper edge;
(i) said foldable flap being foldable to project generally inwardly and downwardly in said interior, bag-receiving, chamber;
(ii) said foldable flap having a bag sealing fold engaging portion thereon oriented to selectively engage and pinch a sealing fold on the inner bag between the foldable flap and the sidewall portion interior wall;
(c) whereby, following opening of the flexible bag, the carton may be used to selectively reseal and contain the flexible bag, by means of said flap securing and maintaining a sealing fold selectively put in the bag.

6. A carton according to claim 5 wherein:
(a) said container has a generally rectangular cross-section with a front wall with an interior side, a rear wall and first and second opposite endwalls;
(b) said foldable flap comprises a generally rectangular tab hingedly mounted on an end wall upper end;
(i) said bag sealing fold engaging portion of said foldable flap comprising a truncated corner of said tab oriented toward said front wall interior side;
(c) whereby the sealing fold in the bag may be selectively trapped between said tab and said front wall by selectively folding said tab inwardly and downwardly in said container until said truncated corner of said tab sufficiently engages the bag sealing fold to pinch same against the front wall.

7. A carton for receiving and retaining an inner, flexible, bag in a sealed orientation; said carton comprising:
(a) a container having a base, a sidewall portion with an upper edge, and an interior, bag-receiving chamber; and
(b) first and second foldable flaps hingedly mounted on said sidewall portion upper edge;
(i) said foldable flaps each being foldable to project generally inwardly and downwardly in said interior, bag-receiving, chamber;
(ii) said foldable flaps each having a bag sealing fold engaging portion thereon oriented to selectively engage and pinch a sealing fold on the inner bag between the foldable flap and the sidewall portion;
(c) whereby, following opening of the flexible bag, the carton may be used to selectively reseal and contain the flexible bag, by means of said flaps securing and maintaining a sealing fold selectively put in the bag.

8. A carton for receiving and retaining an inner, flexible, bag in a sealed orientation; said carton comprising:
(a) a container having a base, a sidewall portion, and an interior, bag-receiving, chamber;
(i) said sidewall portion including a generally planar sidewall with an interior surface;
(b) a plurality of flexible tabs mounted on said container; said flexible tabs each comprising a tab formed in said sidewall face and hingedly attached thereto;
(i) each of said tabs being selectively deformable to project generally inwardly of said container, from said sidewall interior surface;
(ii) said tabs each including a hinged portion generally tending to resist deformation of said tab to project inwardly from said sidewall interior surface;

(c) whereby the tendency of said tab hinged portions to resist projection of said tabs inwardly facilitates sealing the bag received within said container by enabling a sealing fold formed in the bag to become pinched between at least one of said tabs and said sidewall interior surface.

9. A carton according to Claim 8 wherein:

(a) at least two of said tabs are horizontally aligned in said sidewall face to selectively, generally simultaneously, engage the bag sealing fold and pinch same closed at two positions thereon.

10. A carton for receiving and retaining an inner, flexible, bag in a sealed orientation; said carton comprising:

(a) a container having a base, a sidewall portion, and interior, bag-receiving, chamber;

(i) said sidewall portion incuding a sidewall face with a tear-line therein; said tear-line defining a flexible tab selectively formable by rupturing of said sidewall face along said tear-line;

(b) said flexible tab comprising a flap formed in said sidewall face and hingedly attached thereto;

(i) said flap being selectively deformable to project generally inwardly of said container from said sidewall face;

(ii) said flap including a hinged portion generally tending to resist deformation of said flap to project inwardly from said sidewall face;

(c) whereby a bag received within said container interior chamber may be selectively retained in a sealed condition by folding an open end of said bag into a sealing fold and pinching said sealing fold between said flap and said sidewall face.

11. A method of retaining a previously opened bag in a sealed condition within a container; said method including the steps of:

(a) providing a container having a base, and an inner chamber partially formed from an inner sidewall portion;

(b) providing a bag, to be retained, with a sealing fold enclosing a previously opened end thereof;

(c) retaining the bag within said container inner chamber, with the sealing fold generally oriented on an upper end of the bag;

(d) providing a selectively rupturable tear-line in said sidewall portion;

(i) said tear-line defining a flexible tab oriented, upon rupturing of said tear line, to engage the bag sealing fold and trap same between said tab and said container sidewall portion;

(e) rupturing said tear-line to form said flexible tab; and (f) pinching said bag sealing fold between said tab and said sidewall portion, whereupon said bag sealing fold is retained against inner sidewall portion.

* * * * *

Disclaimer 4,676,394.—*Walter Hiersteiner*, Shawnee Mission, Kans. CARTON FOR RECEIVING AND SEALING AN INNER BAG. Patent dated June 30, 1987. Disclaimer filed Feb. 12, 1990, by the inventor.

Hereby enters this disclaimer to claims 1, 5, 6 and 7 of said patent.

[*Official Gazette May 15, 1990* ]